US007584922B2

(12) United States Patent
Bär et al.

(10) Patent No.: US 7,584,922 B2
(45) Date of Patent: Sep. 8, 2009

(54) SPIN-STABILIZED CORRECTIBLE-TRAJECTORY ARTILLERY SHELL

(75) Inventors: Klaus Bär, Lauf (DE); Karl Kautzsch, Schwanstetten (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 0 days.

(21) Appl. No.: 11/950,875

(22) Filed: Dec. 5, 2007

(65) Prior Publication Data

US 2008/0302906 A1 Dec. 11, 2008

(30) Foreign Application Priority Data

Dec. 5, 2006 (DE) ..... 10 2006 057 229

(51) Int. Cl.
*F42B 10/62* (2006.01)
*F42B 10/60* (2006.01)
*F42B 10/00* (2006.01)

(52) U.S. Cl. ..... 244/3.24; 244/3.1; 244/3.15; 244/3.21; 102/473; 102/501; 102/200; 102/206; 102/207

(58) Field of Classification Search ..... 244/3.1–3.3, 244/158.1, 158.9, 171.7, 171.8; 89/1.11; 102/200, 206–209, 473–529, 501; 310/40 R, 310/152, 156.01, 156.08, 156.16, 77; 324/207.11, 324/207.13, 207.2, 207.21; 318/139, 700, 318/400.01, 400.37, 400.38, 560, 611, 623
See application file for complete search history.

(56) References Cited

U.S. PATENT DOCUMENTS 3,156,433 A * 11/1964 White, Jr. ..... 244/158.1
3,606,207 A * 9/1971 Weiner et al. ..... 244/158.9
3,611,943 A * 10/1971 Popper ..... 102/208
3,747,529 A * 7/1973 Plattner ..... 102/209
3,826,193 A * 7/1974 Rognmo et al. ..... 102/208
3,994,228 A * 11/1976 Hurlimann ..... 102/209
4,004,519 A * 1/1977 Hopkins ..... 102/208
4,088,076 A * 5/1978 Karayannis ..... 102/209
4,142,696 A * 3/1979 Nottingham ..... 244/3.16
4,248,153 A * 2/1981 Sjotun et al. ..... 102/208
4,568,039 A * 2/1986 Smith et al. ..... 244/3.15
4,577,116 A * 3/1986 Pinson ..... 310/156.16
4,665,332 A * 5/1987 Meir ..... 310/77
4,898,342 A * 2/1990 Kranz et al. ..... 244/3.21
4,964,593 A * 10/1990 Kranz ..... 244/3.24

(Continued)

FOREIGN PATENT DOCUMENTS

DE 10134785 A1 2/2003

(Continued)

*Primary Examiner*—Bernarr E Gregory
(74) *Attorney, Agent, or Firm*—Laurence A. Greenberg; Werner H. Stemer; Ralph E. Locher

(57) ABSTRACT

A spin-stabilized correctible-trajectory artillery shell has a generator in the rotation-decoupled engagement region between a canard guidance unit and its munition body. The generator can be switched over to avoid load fluctuations between an adjusting motor and a substitute load. In order to avoid an additional heat source in the interior of the guidance unit the substitute load is in the form of an electrical resistance on, at or in canard surfaces behind the afflux flow edges. The canard surfaces are preferably formed on anti-spin canards which are not adjustably mounted.

8 Claims, 1 Drawing Sheet

U.S. PATENT DOCUMENTS

| | | | | |
|---|---|---|---|---|
| 5,115,742 | A * | 5/1992 | Frazer | 102/208 |
| 5,452,864 | A | 9/1995 | Alford et al. | |
| 6,239,511 | B1 | 5/2001 | Joho | |
| 6,845,714 | B1 * | 1/2005 | Smith et al. | 102/208 |
| 7,095,193 | B2 * | 8/2006 | Kellogg et al. | 318/400.38 |
| 7,109,679 | B2 * | 9/2006 | Edson et al. | 318/611 |
| 7,116,100 | B1 * | 10/2006 | Mock et al. | 324/207.25 |
| 7,267,298 | B2 * | 9/2007 | Leininger | 244/3.24 |
| 7,431,237 | B1 * | 10/2008 | Mock et al. | 244/3.24 |
| 2005/0056723 | A1 | 3/2005 | Clancy et al. | |

FOREIGN PATENT DOCUMENTS

| | | | |
|---|---|---|---|
| DE | 10341713 | B3 | 6/2005 |
| EP | 0675335 | A2 | 10/1995 |
| EP | 0984552 | A2 | 3/2000 |

* cited by examiner

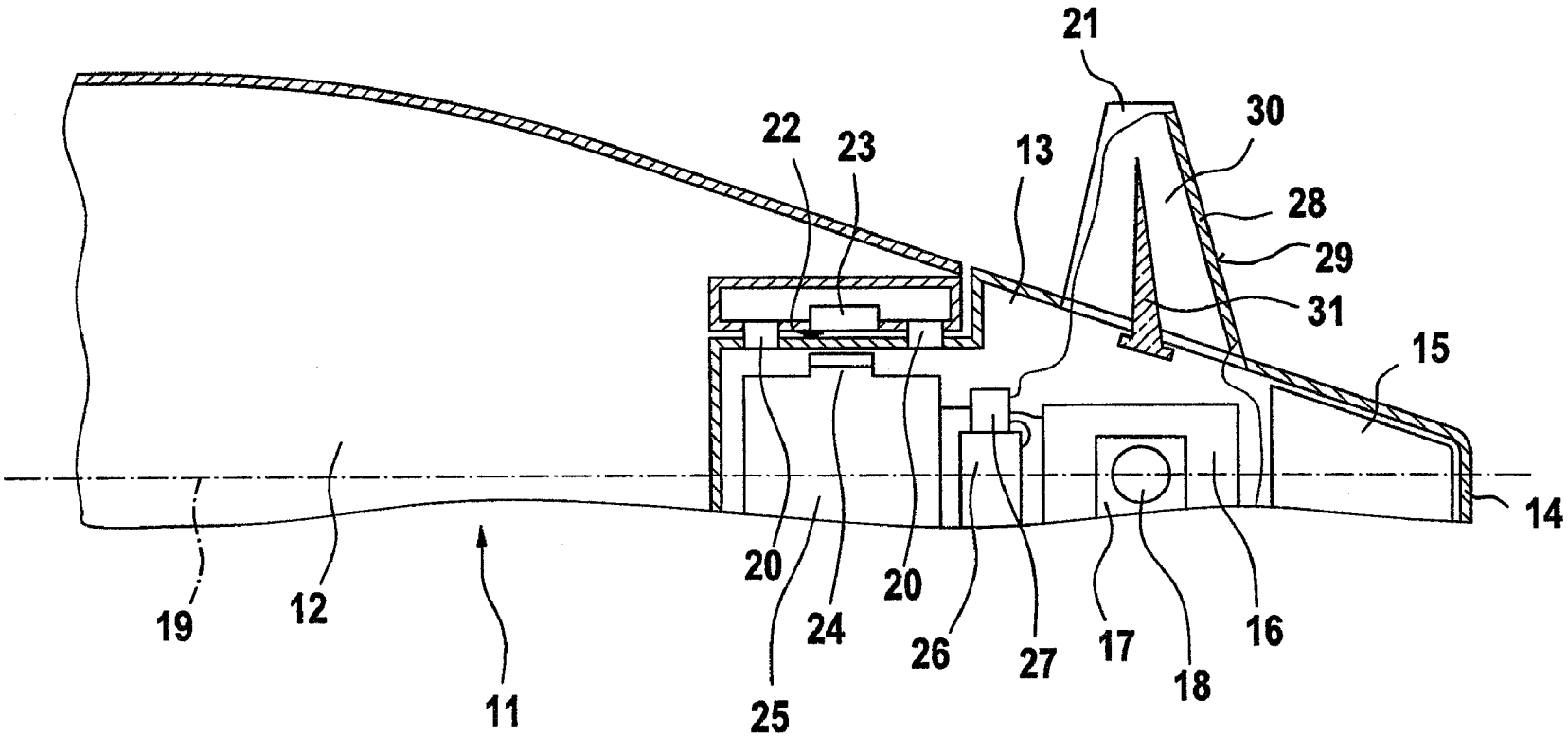
14
15
16
18
17
27
26
20
24
25
20
11
12
19
13
23
22
21
30
28
29
31

SPIN-STABILIZED CORRECTIBLE-TRAJECTORY ARTILLERY SHELL

CROSS-REFERENCE TO RELATED APPLICATION

This application claims the priority, under 35 U.S.C. §119, of German patent application DE 10 2006 057 229.7, filed Dec. 5, 2006, which is herewith incorporated by reference in its entirety.

BACKGROUND OF THE INVENTION

Field of the Invention

The invention pertains to an artillery shell that is spin-stabilized and allows for trajectory correction. The artillery shell has a canard guidance unit that is rotationally decoupled from its munition body and an electrical generator in the engagement region of the guidance unit into the munition body for operation of a canard adjusting system.

A configuration of that kind is known from commonly assigned U.S. Pat. No. 7,267,298 B2 and German patent application DE 1 01 34 785 A1. That artillery shell, referred to as artillery munition, which is unguided in itself is distinguished in that a spatial (that is to say three-dimensional) trajectory correction can be implemented with a sole single-axis pair of guidance canards, that is to say with a control system which in itself is only two-dimensional, and thereby the delivery errors which are system-inherent in themselves can be crucially narrowed down in target-oriented relationship in all directions. The canard vanes which are adjustable by electric motor means with respect to the longitudinal axis of the munition, on the guidance unit, the narrowed front part of the artillery shell, which is roll-decoupled from the munition body, cause a pitching or yawing movement of the artillery shell depending on the respective instantaneous position thereof, as detected by sensor means, in space. Preferably those two canard vanes, for pitch adjustment thereof with respect to the longitudinal axis of the munition, have a common canard shaft which extends transversely with respect to the longitudinal axis of the munition through the guidance unit and which is rotatable by means of a single adjusting motor.

The electrical power for operation of that adjusting motor is obtained by way of the relative speed between the munition body and the guidance unit in a generator which supplies the adjusting motor directly and/or by way of an energy storage device. Generator operation represents a mechanical resistance against the roll motion by virtue of the mass moment of inertia of the shell body. Termination of the operation of the adjusting motor, in comparison with the load situation, represents a relief of the load on the generator and correspondingly influences the reaction movement which is effective between the stator and the rotor of the generator and which in turn has reactions on the instantaneous roll characteristic of the artillery shell and thus its flight stability. Therefore the energy which is not required by the adjusting motor at the time is switched over to a substitute load in order as far as possible to avoid such reactions on the roll characteristic by virtue of a constant loading in respect of the generator.

As the above-mentioned energy storage device can only be small, because of the extremely constricted installation conditions, in practice it is only possible to envisage switching over the adjusting motor to a resistor, as the substitute load. The Joulean heat which is generated therein makes a substantial additional contribution to the thermal radiation of the other functional components such as the generator and the adjusting motor by virtue of induction heating and bearing heating. As a result, the thermal balance sheet in the interior of the guidance unit, which is hermetically sealed in relation to the outside world, can rapidly become functionally critical.

BRIEF SUMMARY OF THE INVENTION

It is accordingly an object of the invention to provide a spin-stabilized, trajectory-correctible artillery ammunition, which overcomes the above-mentioned disadvantages of the heretofore-known devices and methods of this general type and which provides for an artillery shell of the general kind wherein the load-induced thermal radiation does not lead to a critical rise in temperature in the guidance unit.

With the foregoing and other objects in view there is provided, in accordance with the invention, a spin-stabilized correctible-trajectory artillery shell, comprising:

a munition body;

a canard guidance unit rotationally decoupled from the munition body and connected to the munition body in an engagement region, the canard guidance unit including canard surfaces;

a canard adjusting system connected to and adjusting the canard guidance unit;

an electrical generator disposed in the engagement region for powering the canard adjusting system; and a substitute load at or in the canard surfaces, wherein the generator is connected to and can be switched over to the substitute load at or in the canard surfaces.

In a preferred embodiment of the invention, the canard guidance unit is formed with rigidly mounted anti-spin canards.

In other words, the objects of the invention are achieved in that the rise in temperature caused by the substitute load occurs outside the guidance unit, namely in canard surfaces. As a result there is no need for structural measures in the interior of the guidance unit in order to channel those amounts of heat governed by the substitute load and to dissipate them into regions which as far as possible are not critical in terms of function. For, the substitute load no longer contributes to the thermal balance sheet in the interior of the guidance unit because it is only produced outside it, at or in the surfaces of the canard vanes. The rise in temperature which occurs there is in itself already not critical in terms of function and in addition is rapidly dissipated by the afflux flow of air over a large area.

Because the thermal radiation from the substitute load is no longer critical, that also affords extensive options in terms of controlling the relative movement between the munition body and the guidance unit by way of substitute loads which are staggered in respect of the way in which they can be switched over. That is of particular interest if operation of the generator influences the roll rate of the guidance unit by way of a variable energy delivery or is used by way of a constant energy delivery for roll stabilisation purposes. Conversely the generator can also be temporarily operated as a motor from the energy storage means for roll angle adjustment.

In order therefore in accordance with the invention to avoid an additional heat source in the interior of the guidance unit, the substitute load to which the generator can be switched over in the roll-decoupling engagement region of the canard guidance unit of a roll-stabilized correctible-trajectory artillery shell for the avoidance of load fluctuations at the end of operation of the adjusting motor, is in the form of an electrical resistor on, at or in canard surfaces behind the afflux flow edges thereof, and this preferably being in relation to anti-spin canards which are not adjustably mounted.

Additional developments and alternatives to the solution according to the invention are set forth in the further claims and, also having regard to the advantages thereof, the description hereinafter of a preferred embodiment of the invention which is diagrammatically shown in simplified form not entirely true to scale, being restricted to what is essential.

Other features which are considered as characteristic for the invention are set forth in the appended claims.

Although the invention is illustrated and described herein as embodied in spin-stabilized correctible-trajectory artillery shell, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The single FIGURE of the drawing is a partly broken-away view in axial longitudinal section of the configuration of the guidance unit in front of the munition body.

DETAILED DESCRIPTION OF THE INVENTION

Referring now to the FIGURE of the drawing in detail, the artillery munition 11, also referred to as an artillery shell or projectile, which is to be launched in spin-stabilized mode is provided with a guidance unit 13 in front of a munition body 12 which accommodates the payload, instead of being provided with a conventional impact, time or proximity fuse. Behind its radome 14, the guidance unit 13 is equipped with sensor devices 15 for trajectory monitoring and target approach, but in particular also with an adjusting system 16 for trajectory control. For that purpose, an adjusting motor 17 acts on a corresponding lever. In this embodiment, the lever is a single adjusting shaft 18 of a single-axis canard adjusting system 16 which extends transversely with respect to the longitudinal axis 19 of the artillery shell 11 through the guidance unit 13. The latter is a configuration in the form of a hollow cone. The adjusting shaft 18 has its two ends non-rotatably connected to a respective canard adjusting vane. The vanes project radially from the outside contour of the guidance unit 13—but not in over-caliber fashion—in mutually diametrally opposite relationship.

By way of bearing locations 20 which are axially displaced relative to each other and which are preferably in the form of rolling bearings, the guidance unit 13 is roll-decoupled from the munition body 12 into which it engages rearwardly with a tubular connecting portion. Depending on the instantaneous roll position of that engagement region of the guidance unit 13, that is to say also of its adjusting shaft 18 which is disposed in front thereof in the conical region, in relation to the munition body 12, pitch adjustment of the canard adjusting vanes with respect to the longitudinal axis 19 of the munition by rotation of the adjusting shaft 18 thereof leads to a change in trajectory as a consequence of pitching and/or yawing movement of the artillery shell 11. In order dynamically to manage that adjusting procedure, a pair of anti-spin canards 21 is fixed to the guidance unit 13 transversely with respect to the pair of canard adjusting vanes. The canards are at a structurally fixedly predetermined pitch angle with respect to the longitudinal axis of the munition in order to reduce the spin of the guidance unit 13 as soon as possible after the artillery shell is fired from the rifled bore to a value of the order of magnitude of less than ten percent of the stabilisation spin of the munition body 12.

That difference in rotary speed is used in an electrodynamic generator 22 for producing electrical energy in particular for operation of the adjusting motor 17 but also for example for the sensor devices 15. For that purpose the munition body 12 is provided between the bearing locations 20 along a circle which is concentric with respect to the axis 19 with mutually spaced, alternately poled permanent magnets 23. As a consequence of the relative rotary movement between the munition body 12 and the guidance unit 13, the induction coils 24 thereof pass through a magnetic alternating field and thus, without the requirement for slip rings, supply a high-frequency ac voltage to a voltage preparation circuit 25 with rectification in the interior of the tubular connecting portion of the guidance unit 13, which connecting portion carries the generator 22. An energy storage means 26 of small structural size can be re-charged or buffered therefrom, for example for safeguarding an interruption-free power supply for example for the sensor devices 15 or for temporarily switching over to the motor mode of the generator 22; in particular however the adjusting system 16 with its canard adjusting motor 17 is connected to the voltage preparation circuit 25.

The relief of load on the generator 22 which occurs with the termination of the adjusting procedure as a consequence of the adjusting motor 17 being switched off, and the jump in torque that this entails between the guidance unit 13 and the munition body 12 is practically suppressed by a change-over switching logic means 27 diverting the energy demand of the adjusting motor 17 into a substitute load 28 of suitable dimension. The load 28 is provided in or at (that is to say in relation to) the anti-spin canards 21 which are mechanically fixed to the guidance unit 13, for example as diagrammatically shown in the form of elongated conductors closely behind the afflux flow edge 29 of the anti-spin canards 21 or in the form of substantially flat conductors on or in the canard surface 30. In the latter case the respective canard vane of the anti-spin canards 21 can also substantially or entirely comprise electrically conducting material (for example suitably adjusted plastic material), in which case for example an insulating barrier 31 which is indicated in the drawing compels a current flow path which is sufficiently long for an adequately high level of resistance in respect of that substitute load 28.

The crucial consideration is that the joulean heat occurring in the substitute load 28 does not additionally constitute a burden on the thermal balance sheet in the interior of the guidance unit 13 and also does not have to be specifically dissipated from the interior of the guidance unit 13—but is equally generated outside the guidance unit 13 and disposed of in a highly effective fashion by way of the canard surfaces 30. The canard surfaces, of course, have a very strong afflux flow thereagainst.

The invention claimed is:

1. A spin-stabilized correctible-trajectory artillery shell, comprising:

a munition body;

a canard guidance unit rotationally decoupled from said munition body and connected to said munition body in an engagement region, said canard guidance unit including canard surfaces;

a canard adjusting system connected to and adjusting said canard guidance unit;

an electrical generator disposed in said engagement region for powering said canard adjusting system; and a substitute load at or in said canard surfaces, wherein said generator is connected to and can be switched over to said substitute load at or in said canard surfaces.

2. The artillery shell according to claim 1, wherein said canard guidance unit comprises rigidly mounted anti-spin canards.

3. The artillery shell according to claim 1, wherein said substitute load is formed in said canard surfaces.

4. The artillery shell according to claim 1, wherein said canard surfaces include an afflux flow edge and said substitute load is provided along said afflux flow edge.

5. The artillery shell according to claim 1, wherein said substitute load is formed along structurally predetermined flow paths through said canard surfaces.

6. The artillery shell according to claim 1, wherein said substitute load is capable of being switched in a staggered manner.

7. The artillery shell according to claim 1, which comprises a change-over switching logic means connected to said generator, an energy storage means, and a canard adjusting motor, wherein said logic means is configured to switch said generator over to said energy storage means and to said canard adjusting motor or said substitute load.

8. The artillery shell according to claim 7, wherein said change-over switching logic means is connected by way of a voltage preparation circuit to induction coils disposed to rotate in said engagement region of said guidance unit into said munition body between axially mutually-offset bearing locations through a succession of alternate polarities of permanent magnets.

* * * * *